US005862518A

United States Patent [19]

Nomura et al.

[11] Patent Number: 5,862,518

[45] Date of Patent: Jan. 19, 1999

[54] SPEECH DECODER FOR DECODING A SPEECH SIGNAL USING A BAD FRAME MASKING UNIT FOR VOICED FRAME AND A BAD FRAME MASKING UNIT FOR UNVOICED FRAME

[75] Inventors: Toshiyuki Nomura; Kazunori Ozawa, both of Tokyo, Japan

[73] Assignee: NEC Corporation, Tokyo, Japan

[21] Appl. No.: 172,171

[22] Filed: Dec. 23, 1993

[30] Foreign Application Priority Data

Dec. 24, 1992 [JP] Japan ..... 4-343723

[51] Int. Cl.[6] ..... G10L 3/02

[52] U.S. Cl. ..... 704/214; 704/201; 704/211; 704/226

[58] Field of Search ..... 395/2.17, 2.23, 395/2.35, 2.37, 2.67, 2.73, 2.29

[56] References Cited

U.S. PATENT DOCUMENTS

| | | | |
|---|---|---|---|
| 4,331,837 | 5/1982 | Soumagne | 395/2.23 |
| 4,589,131 | 5/1986 | Horvarth et al. | 395/2.23 |
| 4,720,862 | 1/1988 | Nakata et al. | 704/214 |
| 5,073,940 | 12/1991 | Zinser et al. | 704/226 |
| 5,142,582 | 8/1992 | Asakawa et al. | 704/228 |
| 5,197,113 | 3/1993 | Mumolo | 395/2.23 |
| 5,226,084 | 7/1993 | Harowick et al. | 704/219 |
| 5,305,332 | 4/1994 | Ozawa | 371/31 |

FOREIGN PATENT DOCUMENTS

| | | |
|---|---|---|
| 0 186 763 | 7/1986 | European Pat. Off. . |
| 0 296 764 | 12/1988 | European Pat. Off. . |

OTHER PUBLICATIONS

L. DaSilva et al., "A Class–Oriented Replacement Technique for Lost Speech Packets," IEEE Infocom'89, Sep. 1989 vol. 3, pp. 1098–1105.

McLaughlin, M. J., "*Channel Coding for Digital Speech Transmission in the Japanese Digital Cellular System*", pp. 41–45, Chicago Corporate Research and Development Center, Motorola, Inc., Chicago, IL.

*Primary Examiner*—David R. Hudspeth
*Assistant Examiner*—Michael N. Opsasnick
*Attorney, Agent, or Firm*—Foley & Lardner

[57] ABSTRACT

A receiving unit receives input speech data on a frame-by-frame basis. An error detection unit checks whether errors exist in each frame, and outputs a signal indicative thereof to a first switch circuit. The first switch circuit outputs the input speech data to a second switch circuit if an error is detected, while it outputs the input speech data to a speech decoder unit if no error is detected. A data memory stores the input speech data after delaying the data by one frame, and outputs the delayed data to a bad frame masking unit for voiced frame, and a bad frame masking unit for unvoiced frame. The speech decoder unit decodes the input speech data by using spectral parameter data, delay of an adaptive codebook, an index of an excitation codebook, gains of the adaptive and excitation codebooks, and the amplitude of the input speech signal. The speech decoder unit outputs a decoding result to a voiced/unvoiced frame judging unit, as well as to an output terminal. The voiced/unvoiced frame judging unit determines whether a current frame is a voiced frame or an unvoiced frame, and outputs the result of the check to a second switch circuit. The second switch circuit outputs the input data to the bad frame masking unit for voiced frame if it is determined that the current frame is a voiced frame, and it outputs the input data to the bad frame masking unit for unvoiced frame if it is determined that the current frame is an unvoiced frame.

9 Claims, 7 Drawing Sheets

SPEECH DECODER FOR DECODING A SPEECH SIGNAL USING A BAD FRAME MASKING UNIT FOR VOICED FRAME AND A BAD FRAME MASKING UNIT FOR UNVOICED FRAME

BACKGROUND OF THE INVENTION

This invention relates to a speech decoder for high quality decoding a speech signal which has been transmitted at a low bit rate, particularly at 8 kb/sec or below.

A well-known speech decoder concerning frames with errors, is disclosed in a treatise entitled "Channel Coding for Digital Speech Transmission in the Japanese Digital Cellular System" by Michael J. McLaughlin (Radio Communication System Research Association, RC590-27, p-p 41–45). In this system, in a frame with errors, the spectral parameter data and delay of an adaptive codebook having an excitation signal determined in the past are replaced with previous frame data. In addition, the amplitude in a past frame without errors is reduced in a predetermined ratio to use the reduced amplitude as the amplitude for the current frame. In this way, a speech signal is reproduced. Further, if more errors than the predetermined number of frames are detected continuously, the current frame is muted.

In this prior art system, however, the spectral parameter data in the previous frame, the delay and the amplitude as noted above are used repeatedly irrespective of whether the frame with errors is a voiced or an unvoiced one. Therefore, in the reproduction of the speech signal the current frame is processed as a voiced one if the previous frame is a voiced one, while it is processed as an unvoiced one if the previous frame is an unvoiced one. This means that if the current frame is a transition frame from a voiced to an unvoiced one, it is impossible to reproduce a speech signal having unvoiced features.

SUMMARY OF THE INVENTION

An object of the present invention is, therefore, to provide a speech decoder with highly improved speech quality even for the voiced/unvoiced frame.

According to the present invention, there is provided a speech decoder comprising a receiving unit for receiving spectral parameter data transmitted for each frame having a predetermined interval, pitch information corresponding to the pitch period, index data of an excitation signal and a gain. The speech decoder also comprises a speech decoder unit for reproducing speech by using the spectral parameter data, the pitch information, the excitation code index and the gain. The speech decoder further comprises an error correcting unit for correcting channel errors, an error detecting unit for detecting errors incapable of correction, a voiced/unvoiced frame judging unit for deriving, in a frame with an error thereof detected in the error detecting unit, a plurality of feature quantities and judging whether the current frame is a voiced or an unvoiced one from the plurality of feature quantities and predetermined threshold value data. The speech decoder comprises a bad frame masking unit for voiced frame for reproducing, in a frame with an error thereof detected in the error detecting unit and determined to be a voiced frame in the voiced/unvoiced frame judging unit, a speech signal of the current frame by using the spectral parameter data of the past frame, the pitch information, the gain and the excitation code index of the current frame. The speech decoder also comprises a bad frame masking unit for unvoiced frame for reproducing, in a frame with an error thereof detected in the error detecting unit and determined to be an unvoiced frame in the voiced/unvoiced frame judging unit, the speech signal of the current frame by using the spectral parameter data of the past frame, the gain and the excitation code index of the current frame. The bad frame masking units for voiced and unvoiced frames are switched over to one another according to the result of the check in the voiced/unvoiced frame judging unit.

In the above-described decoder, in repeated use of the spectral parameter data in the past frame in the bad frame masking units for voiced and unvoiced frames, the spectral parameter data is changed by combining the spectral parameter data of the past frame and robust-to-error part of the spectral parameter data of the current frame with an error.

When obtaining the gains of the obtained excitation and the excitation signal in the bad frame masking unit for voiced frame according to the pitch information for forming an excitation signal, gain retrieval is done such that the power of the excitation signal of the past frame and the power of the excitation signal of the current frame are equal to each other.

Other objects and features will be clarified from the following description with reference to the attached drawings.

PREFERRED EMBODIMENTS OF THE INVENTION

A speech decoder will now be described in case where a CELP method is used as a speech coding method for the sake of simplicity.

Figure 1:
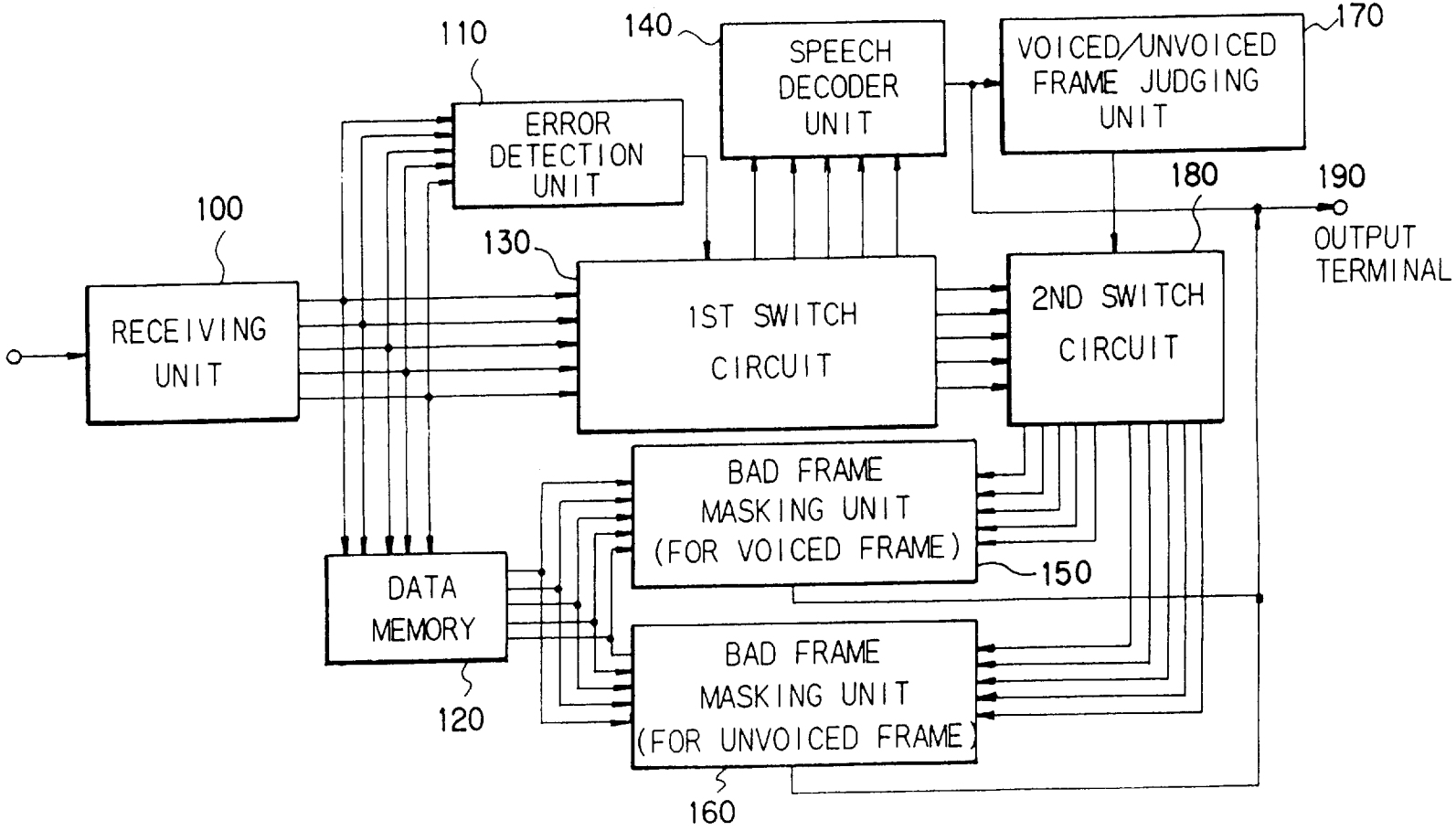
FIG. 1 is a block diagram showing a speech decoder embodying a first aspect of the invention.

Reference is made to the accompanying drawings. FIG. 1 is a block diagram showing a speech decoding system embodying a first aspect of the invention. Referring to FIG. 1, a receiving unit 100 receives spectral parameter data transmitted for each frame (of 40 msec for instance), a delay of an adaptive codebook having an excitation signal determined in the past (corresponding to pitch information), an index of an excitation codebook comprising an excitation signal, gains of the adaptive and excitation codebooks and an amplitude of a speech signal, and outputs these input data to an error detection unit 110, a data memory 120 and a first switch circuit 130. The error detection unit 110 checks whether errors are produced in perceptually important bits by channel errors and outputs the result of the check to the first switch circuit 130. The first switch circuit 130 outputs the input data to a second switch circuit 180 if an error is detected in the error detection unit 110, while it outputs the input data to a speech decoder unit 140 if no error is detected. The data memory 120 stores the input data after delaying the data by one frame, and outputs the stored data to bad frame masking units 150 and 160 for voiced and unvoiced frames, respectively. The speech decoder unit 140 decodes the speech signal by using the spectral parameter data, the delay of the adaptive codebook having an excitation signal determined in the past, the index of the excitation codebook comprising the excitation signal, gains of the adaptive and excitation codebooks and the amplitude of the speech signal, and outputs the result of decoding to a voiced/unvoiced frame judging unit 170 and also to an output terminal 190. The voiced/unvoiced frame judging unit 170 derives a plurality of feature quantities from the speech signal that has been reproduced in the speech decoder unit 140 in the previous frame. Then, it checks whether the current frame is a voiced or unvoiced one, and outputs the result of the check to the second switch circuit 180. The second switch circuit 180 outputs the input data to the bad frame masking unit 150 for voiced frame if it is determined in the voiced/unvoiced frame judging unit 170 that the current frame is a voiced one. If the current frame is an unvoiced one, the second switch circuit 180 outputs the input data to the bad frame masking unit 160 for an unvoiced frame. The bad frame masking unit 150 for a voiced frame, interpolates the speech signal by using the data of the previous and current frames and outputs the result to the output terminal 190. The bad frame masking unit 160 for an unvoiced frame interpolates the speech signal by using data of the previous and current frames and outputs the result to the output terminal 190.

Figure 2:
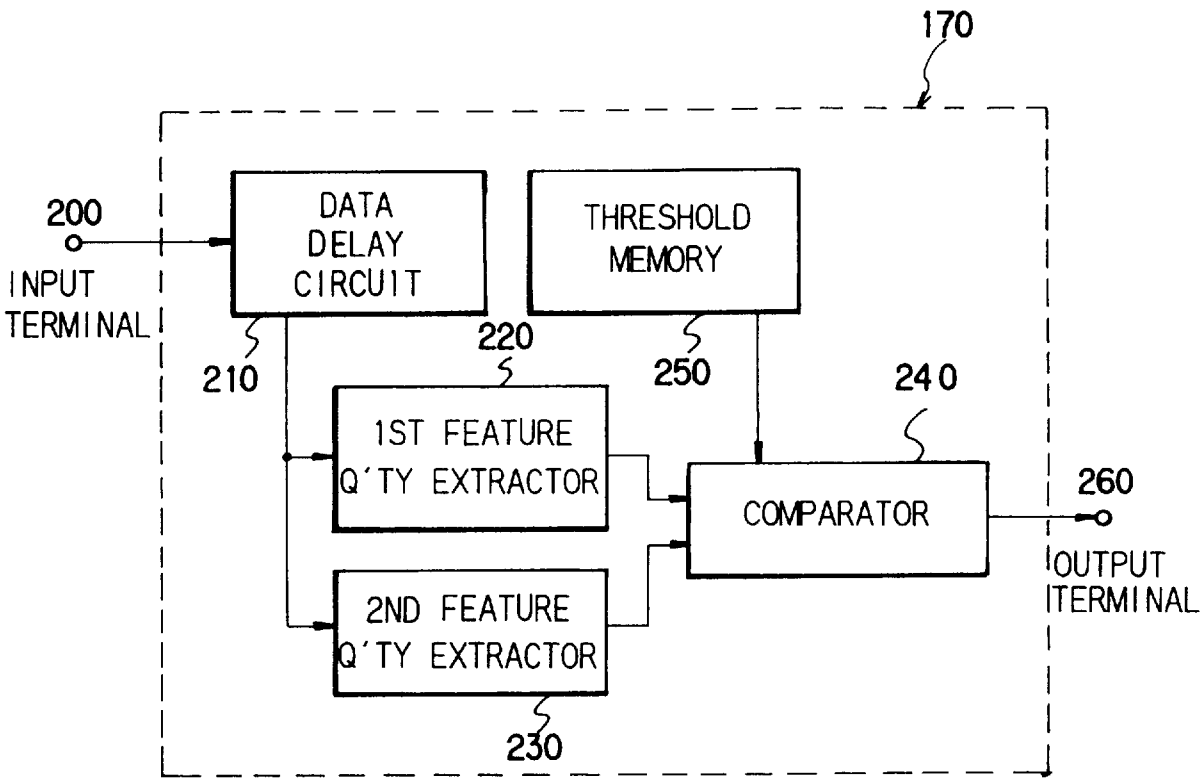
FIG. 2 is a block diagram showing a structure example of a voiced/unvoiced frame judging unit 170 in the speech decoder according to the first aspect of the invention.

FIG. 2 is a block diagram showing a structure example of the voiced/unvoiced frame judging unit 170 in this embodiment. For the sake of simplicity, a case will be considered, in which two different kinds of feature quantities are used for the voiced/unvoiced frame judgment. Referring to FIG. 2, a speech signal which has been decoded for each frame (of 40 msec for instance) is input from an input terminal 200 and output to a data delay circuit 210. The data delay circuit 210 delays the input speech signal by one frame and outputs the delayed data to a first and a second feature quantity extractor 220 and 230. The first feature quantity extractor 220 derives a pitch estimation gain representing the periodicity of the speech signal by using formula (1) and outputs the result to a comparator 240. The second feature quantity extractor 230 calculates the rms of the speech signal for each of subframes as divisions of a frame and derives the change in the rms by using formula (2), the result being output to the comparator 240. The comparator 240 compares the two different kinds of feature quantities that have been derived in the first and second feature quantity extractors 220 and 230 to threshold values of the two feature quantities that are stored in a threshold memory 250. By so doing, the comparator 240 checks whether the speech signal is a voiced or an unvoiced one, and outputs the result of the check to an output terminal 260.

Figure 3:
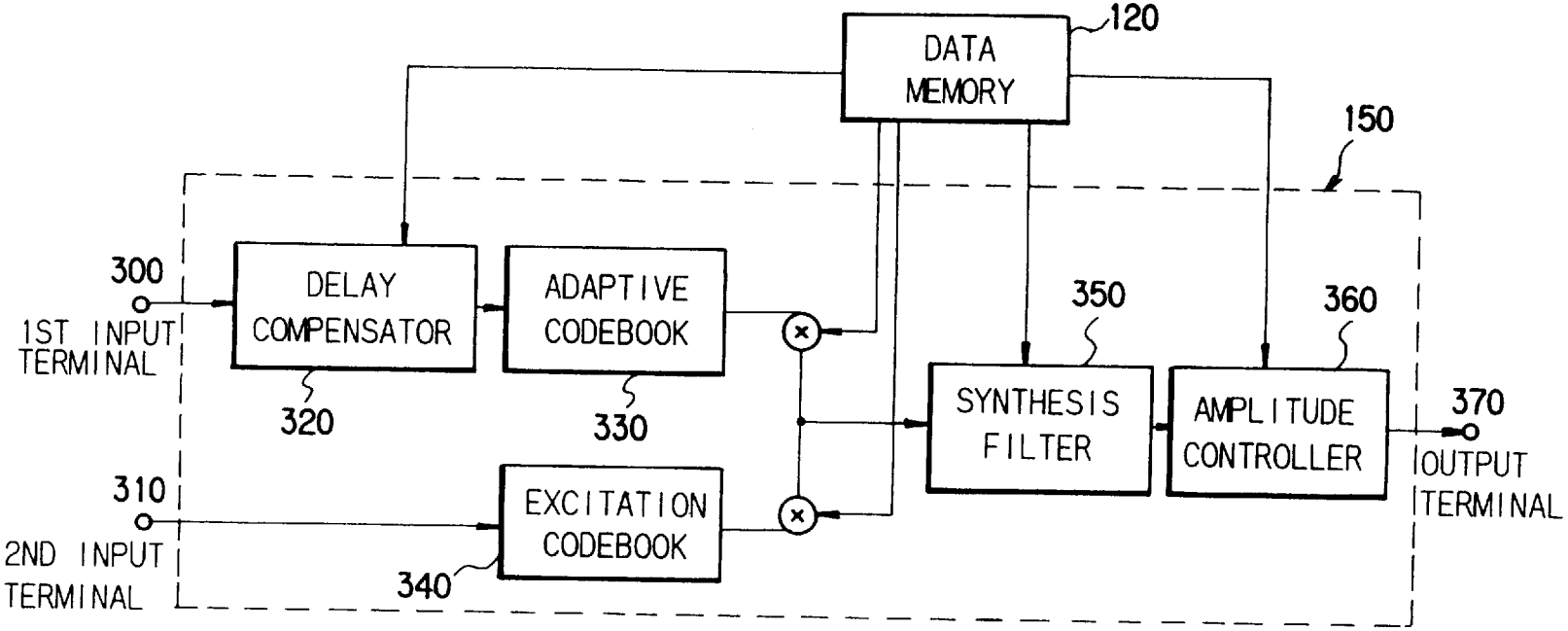
FIG. 3 is a block diagram showing a structure example of a bad frame masking unit 150 for a voiced frame in the speech decoder according to the first aspect of the invention.

FIG. 3 is a block diagram showing a structure example of the bad frame masking unit 150 for a voiced frame in the embodiment. Referring to FIG. 3, the delay of the adaptive codebook is input from a first input terminal 300 and is output to a delay compensator 320. The delay compensator 320 compensates the delay of the current frame according to the delay of the previous frame having been stored in the data memory 120 by using formula (3). The index of the excitation codebook is input from a second input terminal 310, and an excitation code vector corresponding to that index is output from an excitation codebook 340. A first signal is obtained by multiplying the excitation code vector by the gain of the previous frame that has been stored in the data memory 120, and a second signal is obtained by multiplying the adaptive code vector output from an adaptive codebook 330 with the compensated adaptive codebook delay by the gain of the previous frame that has been stored in the data memory 120. The first and second signals are added together, and the resultant sum is output to a synthesis the filter 350. The synthesis filter 350 synthesizes the speech signal by using a previous frame filter coefficient stored in the data memory 120 and outputs the resultant speech signal to an amplitude controller 360. The amplitude controller 360 executes amplitude control by using the previous frame rms stored in the data memory 120, and it outputs the resultant speech signal to an output terminal 370.

Figure 4:
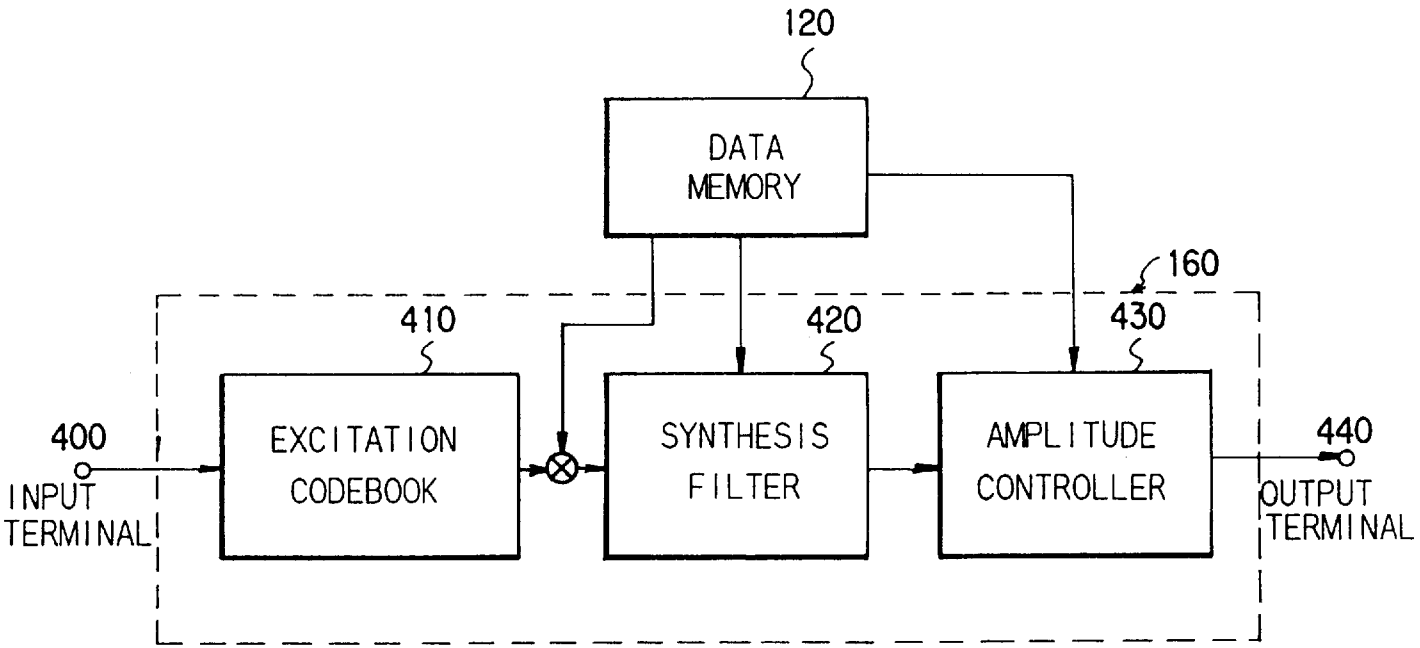
FIG. 4 is a block diagram showing a structure example of a bad frame masking unit 160 an unvoiced frame in the speech decoder according to the first aspect of the invention.

FIG. 4 is a block diagram showing a structure example of the bad frame masking unit 160 for an unvoiced frame in the embodiment. Referring to FIG. 4, the index of the excitation codebook is input from an input terminal 400, and an excitation code vector corresponding to that index is output from an excitation codebook 410. The excitation code vector is multiplied by the previous frame gain that is stored in the data memory 120, and the resultant product is output to a synthesis filter 420. The synthesis filter 420 synthesizes the speech signal by using a previous frame filter coefficient stored in the data memory 120 and outputs the resultant speech signal to an amplitude controller 430. The amplitude controller 430 executes amplitude control by using a previous frame rms stored in the data memory 120 and outputs the resultant speech signal to an output terminal 440.

Figure 5:
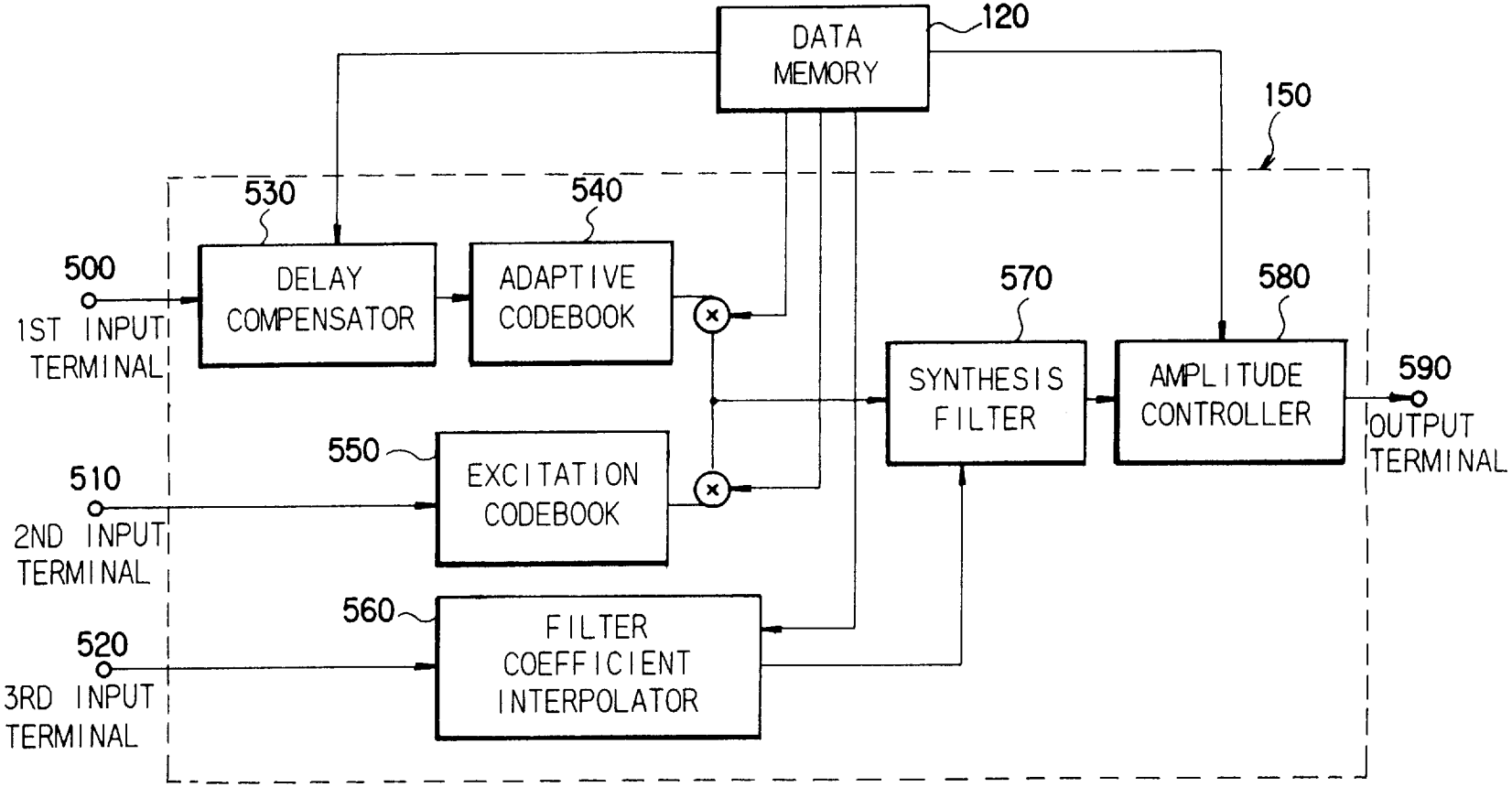
FIG. 5 is a block diagram showing a structure example of a bad frame masking unit 150 for an voiced frame in a speech decoder according to a second aspect of the invention.

FIG. 5 is a block diagram showing a structure example of bad frame masking unit 150 for a voiced frame in a speech decoder embodying a second aspect of the invention. Referring to FIG. 5, the adaptive codebook delay is input from a first input terminal 500 and output to a delay compensator 530. The delay compensator 530 delays the delay of the current frame with previous delay data stored in the data memory 120 by using formula (3). The excitation codebook index is input from a second input terminal 510, and an excitation code vector corresponding to that index is output from an excitation codebook 550. A first signal is obtained by multiplying the excitation code vector by a previous frame gain stored in the data memory 120, and a second signal is obtained by multiplying the adaptive code vector output from an adaptive codebook 540 with the compensated adaptive codebook delay by the previous frame gain stored in the data memory 120. The first and second signals are added together, and the resultant sum is output to a synthesis filter 570. A filter coefficient interpolator 560 derives a filter coefficient by using previous frame filter coefficient data stored in the data memory 120 and robust-to-error part of filter coefficient data of the current frame having been input from a third input terminal 520, and outputs the derived filter coefficient to a synthesis filter 570. The synthesis filter 570 synthesizes the speech signal by using this filter coefficient and outputs this speech signal to an amplitude controller 580. The amplitude controller 580 executes amplitude control by using a previous frame rms stored in the data memory 120, and outputs the resultant speech signal to an output terminal 590.

Figure 6:
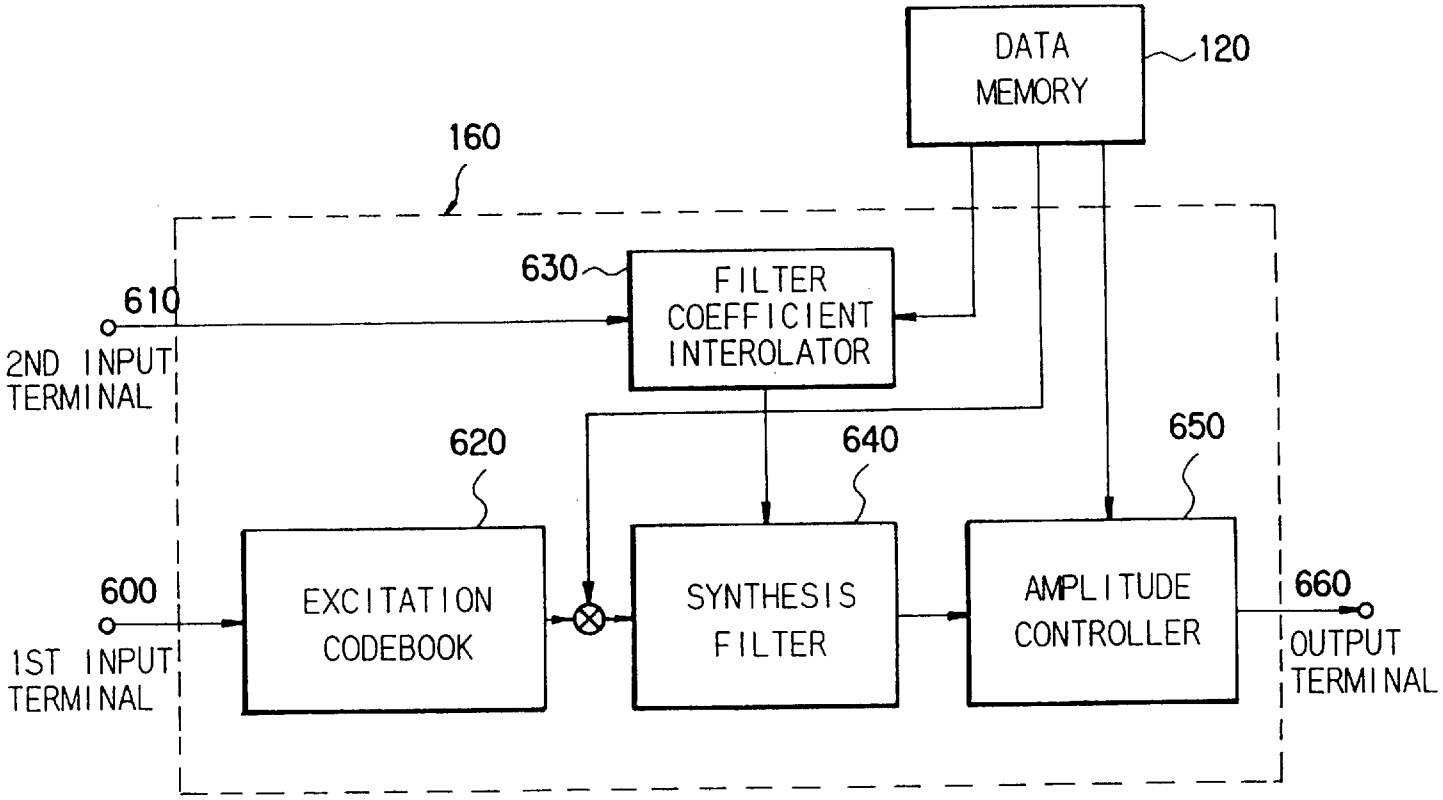
FIG. 6 is a block diagram showing a structure example of a bad frame masking unit 160 for an unvoiced frame in the speech decoder according to the second aspect of the invention.

FIG. 6 is a block diagram showing a structure example of bad frame masking unit 160 for an unvoiced frame in the speech decoder embodying the second aspect of the invention. Referring to FIG. 6, the excitation codebook index is input from a first input terminal 600, and an excitation code vector corresponding to that index is output from an excitation codebook 620. The excitation code vector is multiplied by a previous frame gain stored in the data memory 120, and the resultant product is output to a synthesis filter 640. A filter coefficient interpolator 630 derives a filter coefficient by using previous frame filter coefficient data stored in the data memory 120 and robust-to-error part of current frame filter coefficient data input from a second input terminal 610, and outputs this filter coefficient to a synthesis filter 640. The synthesis filter 640 synthesizes the speech signal by using this filter coefficient, and outputs this speech signal to an amplitude controller 650. The amplitude controller 650 executes amplitude control by using a previous frame rms stored in the data memory 120 and outputs the resultant speech signal to an output terminal 660.

Figure 7:
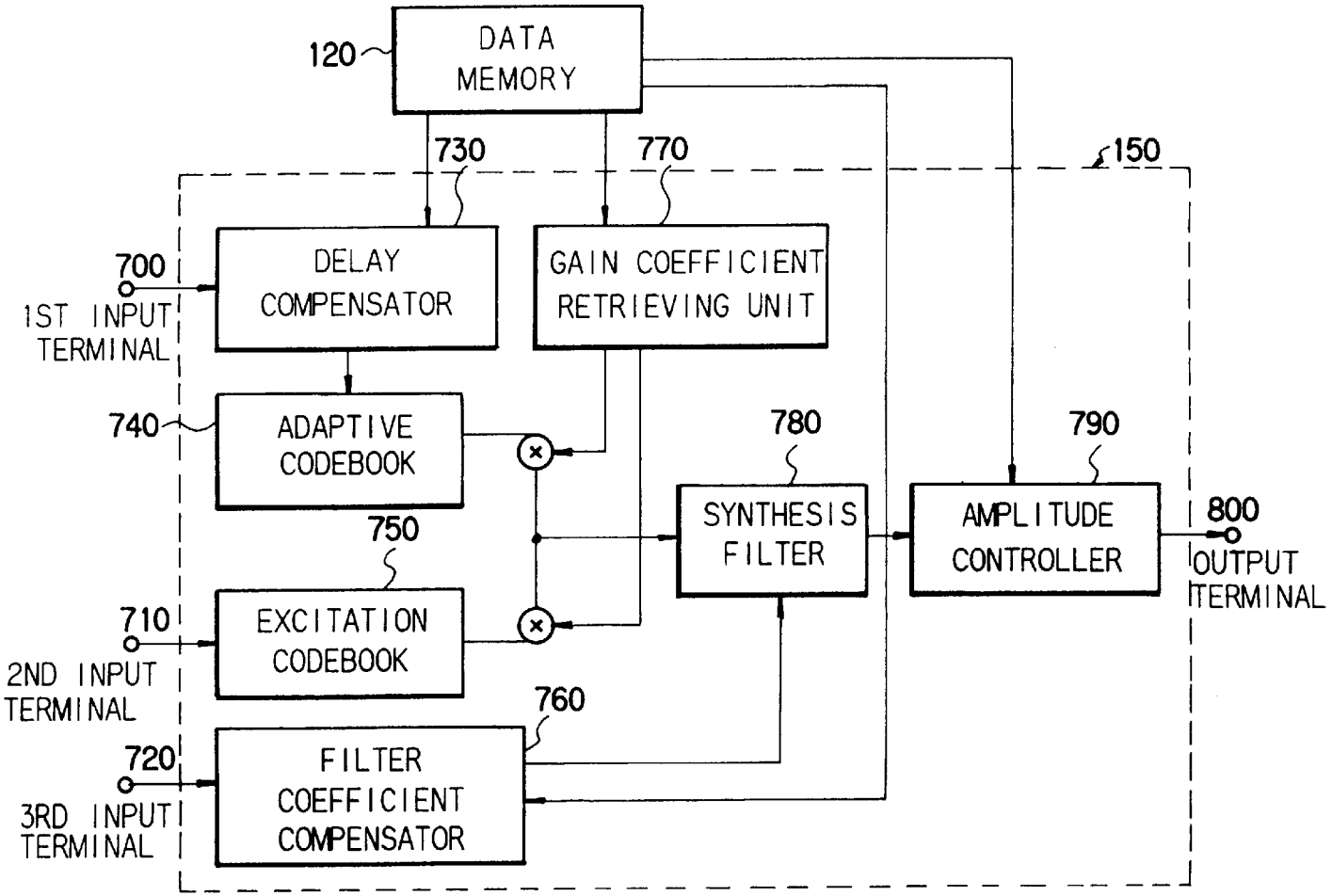
FIG. 7 is a block diagram showing a structure example of a bad frame masking unit 150 for a voiced frame according to a third aspect of the invention.

FIG. 7 is a block diagram showing a structure example of a bad frame masking unit 150 in a speech decoder embodying a third aspect of the invention. Referring to FIG. 7, the adaptive codebook delay is input from a first input terminal 700 and output to a delay compensator 730. The delay compensator 730 compensates the delay of the current frame with the previous frame delay that has been stored in the data memory 120 by using formula (3). A gain coefficient retrieving unit 770 derives the adaptive and excitation codebook gains of the current frame according to previous frame adaptive and excitation codebook gains and rms stored in the data memory 120 by using formula (4). The excitation code index is input from a second input terminal 710, and an excitation code vector corresponding to that index is output from an excitation codebook 750. A first signal is obtained by multiplying the excitation codebook vector by the gain obtained in a gain coefficient retrieving unit 770, and a second signal is obtained by multiplying the adaptive code vector output from an adaptive codebook 740 with the compensated adaptive codebook delay by the gain obtained in the gain coefficient retrieving unit 770. The first and second signals are added together, and the resultant sum is output to a synthesis filter 780. A filter coefficient compensator 760 derives a filter coefficient by using previous frame filter coefficient data stored in the data memory 120 and robust-to-error part of filter coefficient data of the current frame input from a third input terminal 720, and outputs this filter coefficient to a synthesis filter 780. The synthesis filter 780 synthesizes speech signal by using this filter coefficient and outputs the resultant speech signal to an amplitude controller 790. The amplitude controller 790 executes amplitude control by using the previous frame rms stored in the data memory 120, and outputs the resultant speech signal to an output terminal 800. Pitch estimation gain G is obtained by using a formula, $$G = 10 \times \log_{10} \frac{\langle x, x \rangle}{\langle x, x \rangle - \frac{\langle c, x \rangle^2}{\langle c, c \rangle}} \tag{1}$$

where x is a vector of the previous frame, and c is a vector corresponding to a past time point earlier by the pitch period. Shown as (,) is the inner product. Denoting the rms of each of the sub-frames of the previous frame by $rms_1$ $rms_2, \ldots,$ $rms_5$, the change V in rms is given by the following formula. In this case, the frame is divided into five sub-frames.

$$V = 20 \times \log_{10} \frac{rms_3 + rms_4 + rms_5}{rms_1 + rms_2 + rms_3} \tag{2}$$

Using the previous frame delay Lp and current frame delay L, we have $$0.95xL_p < L < 1.05 \times L_p \tag{3}$$

If L meets formula (3), L is determined to be the delay of the current frame. Otherwise, $L_p$ is determined to be the delay of the current frame.

A gain for minimizing the next error $E_I$ is selected with the following formula (4):

$$E_i = \left| R_p \times \sqrt{G_{ap}^2 + G_{ep}^2} - R \times \sqrt{G_{ai}^2 + G_{ei}^2} \right| \tag{4}$$

where $R_p$ is the previous frame rms, R is the current frame rms, $G_{ap}$ and $G_{ep}$ are gains of the previous frame adaptive and excitation codebooks, and $G_{ai}$ and $G_{ei}$ are the adaptive and excitation codebook gains of index i.

It is possible to use this system in combination with a coding method other than the CELP method as well.

As has been described in the foregoing, according to the first aspect of the invention it is possible to obtain satisfactory speech quality with the voiced/unvoiced frame judging unit executing a check as to whether the current frame is a voiced or an unvoiced one and by switching the bad frame masking procedure of the current frame between the bad frame masking units for voiced and unvoiced frames. The second aspect of the invention makes it possible to obtain higher speech quality by causing, while repeatedly using the spectral parameter of the past frame, changes in the spectral parameter by combining the spectral parameter of the past frame and robust-to-error part of error-containing spectral parameter data of the current frame. Further, according to the third aspect of the invention, it is possible to obtain higher speech quality by executing retrieval of the adaptive and excitation codebook gains such that the power of the excitation signal of the past frame and that of the current frame are equal.

What is claimed is:

1. A speech decoder, comprising:

a receiving unit for receiving and outputting parameters of spectral data, pitch data corresponding to a pitch period, and index data, and gain data of an excitation signal for each frame having a predetermined interval of a speech signal;

a speech decoder unit for reproducing a speech signal by using said parameters;

an error correcting unit for correcting an error in said speech signal;

an error detecting unit for detecting an error frame incapable of correction in said speech signal;

a voiced/unvoiced frame judging unit for judging whether said error frame detected by said error detecting unit is a voiced frame or an unvoiced frame based upon a plurality of feature quantities of a speech signal reproduced in a past frame;

a bad frame masking unit for voiced frame for reproducing a speech signal of the error frame detected by said error detecting unit and which is judged as a voiced frame by using said spectral data, said pitch data and said gain data of the past frame, and said index data of said error frame;

a bad frame masking unit for unvoiced frame for reproducing a speech signal of the error frame detected by said error detecting unit and which is judged as an unvoiced frame by using said spectral data and said gain data of the past frame and said index data of said error frame; and a switching unit for outputting one of the voiced frame and the unvoiced frame according to the judgment result in said voiced/unvoiced frame judging unit.

2. The speech decoder according to claim 1, wherein in repeated use of said spectral data in the past frame of said bad frame masking units for voiced or unvoiced frames, said spectral data is changed based upon a combination of said spectral data of the past frame and robust-to-error part of said spectral data of the error frame.

3. The speech decoder according to claim 1, wherein gains of the obtained excitation based upon said pitch data and said excitation signal in said bad frame masking unit for voiced frame are calculated such that a power of said excitation signal of the past frame and power of said excitation signal of the error frame are equal to each other.

4. A speech decoder, comprising:

a receiving unit for receiving and outputting input data, the input data including spectral data transmitted for each of a plurality of frames, delay of an adaptive codebook having a predetermined excitation signal corresponding to a pitch data, an index of excitation codebook constituting an excitation signal, gains of the adaptive and excitation codebooks and an amplitude of a speech signal;

an error detection unit for checking whether an error of said each frame occurs based upon said corresponding input data having errors in perceptually important bits;

a data memory for storing the input data after delaying the data by one frame;

a speech decoder unit for decoding, when no error is detected by said error detection unit, the speech signal by using the spectral data, delay of the adaptive codebook having the predetermined excitation signal, index of the excitation codebook comprising the excitation signal, gains of the adaptive and excitation codebooks and the amplitude of the speech signal;

a voiced/unvoiced frame judging unit for deriving a plurality of feature quantities from the speech signal that has been reproduced in said speech decoder unit in a previous frame and for checking whether a current frame is a voiced or unvoiced frame;

a bad frame masking unit for voiced frame for interpolating, when an error is detected and the current frame is the voiced frame, the speech signal by using the data of the previous and current frames; and a bad frame masking unit for unvoiced frame for interpolating, when an error is detected and the current frame is the unvoiced frame, the speech signal by using data of the previous and current frames.

5. A speech decoder, comprising:

a receiving unit configured to receive and output spectral data for each of a plurality of sequential frames, pitch information corresponding to a pitch period of said each sequential frame, index data of an excitation signal, and a gain, wherein each sequential frame has a fixed frame period, and wherein two of said sequential frames corresponds respectively to a current frame and a previous frame contiguous with said current frame;

an error detecting unit connected to the receiving unit and configured to detect channel errors in predetermined bit positions of the input data that is output from the receiving unit;

a data memory connected to the receiving unit and configured to delay and store the spectral data output from the receiving unit, the delay corresponding to the fixed frame period;

a first switch connected to the error detecting unit and the receiving unit and configured to output the spectral data received from the receiving unit for the current frame along a first data path if the error detecting unit indicates an error in at least one of the predetermined bit positions of the spectral data of the current frame, the first switch configured to output the input data received from the receiving unit for the current frame along a second data path if the error detecting unit indicates no errors in any of the at least one of the predetermined bit positions of the spectral data of the current frame;

a speech decoder unit configured to reproduce speech from data that is received from the first switch over the second data path;

a voiced/unvoiced frame judging unit connected to the speech decoder unit and configured to derive, if the current frame has an error in at least of the predetermined bit positions, a plurality of feature quantities and to judge whether the current frame is a voiced frame or an unvoiced frame based on the feature quantities and a predetermined threshold value, the voiced/unvoiced frame judging unit configured to output a first judging signal as a result thereof;

a second switch connected to the first switch via the first data path and connected to the voiced/unvoiced frame judging unit, the second switch configured to output data received from the first switch over the first data path to one of a third data path and a fourth data path in accordance with a state of the first judging signal;

a bad frame masking unit for voiced frame connected to the second switch via the third data path and connected to the data memory, the bad frame masking unit configured to interpolate data received via the third data path from the second switch in accordance with the spectral data stored in the data memory; and a bad frame masking unit for unvoiced frame connected to the second switch via the fourth data path and connected to the data memory, the bad frame masking unit configured to interpolate data received via the fourth data path from the second switch in accordance with the spectral data stored in the data memory.

6. The speech decoder according to claim 5, further comprising an output terminal connected to the speech decoder unit, the bad frame masking unit for voiced frame, and the bad frame masking unit for unvoiced frame.

7. The speech decoder according to claim 5, wherein the voiced/unvoiced judging unit comprises:

a data delay circuit for delaying the current frame by the fixed frame period and to output a delayed frame as a result thereof;

a first feature quantity extractor connected to the data delay circuit and configured to derive a pitch estimation gain representing a periodicity of a speech signal in the delayed frame and to output a first derived signal as a result thereof;

a second feature quantity extractor connected to the data delay circuit and configured to calculate an rms of the speech signal resident in each of a plurality of subframes of the delayed frame, the second feature quantity extractor configured to output a second calculated signal as a result thereof; and a comparator connected to the first and second feature quantity extractors and configured to compare the first derived signal with a first threshold value and to compare the second calculated signal with a second threshold value and to output an indication of whether the delayed frame is a voiced frame or an unvoiced frame as a result thereof.

8. The speech decoder according to claim 2, wherein said robust-to-error part of said spectral data is a parameter which is acoustically insensitive to a transmission line error.

9. The speech decoder according to claim 1, wherein in repeated use of said spectral data in the past frame of said bad frame masking units for voiced and unvoiced frames, said spectral data is changed based upon a combination of said spectral data of the past frame and an insensitive-to-error part of said spectral data of the error frame.

* * * * *